US011352229B2

(12) United States Patent
Nagubadi

(10) Patent No.: US 11,352,229 B2
(45) Date of Patent: Jun. 7, 2022

(54) COMPRESSED CORELESS ROLL OF SHEET PRODUCT HAVING A CENTER INDICATOR

(71) Applicant: GPCP IP Holdings LLC, Atlanta, GA (US)

(72) Inventor: Rajendra P. Nagubadi, Johns Creek, GA (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 16/863,528

(22) Filed: Apr. 30, 2020

(65) Prior Publication Data

US 2020/0255244 A1 Aug. 13, 2020

Related U.S. Application Data

(62) Division of application No. 15/908,622, filed on Feb. 28, 2018, now abandoned.

(60) Provisional application No. 62/476,915, filed on Mar. 27, 2017.

(51) Int. Cl.

| | |
|---|---|
| ***B65H 18/28*** | (2006.01) |
| ***B65H 18/04*** | (2006.01) |
| ***B65B 63/02*** | (2006.01) |
| ***B65B 63/00*** | (2006.01) |

(52) U.S. Cl.

CPC ..... *B65H 18/28* (2013.01); *B65H 18/04* (2013.01); *B65B 63/005* (2013.01); *B65B 63/02* (2013.01); *B65H 2406/20* (2013.01); *B65H 2701/1924* (2013.01)

(58) Field of Classification Search

CPC ..... B65H 18/04; B65H 18/28; B65H 18/00; B65H 26/066; B65H 26/08; B65H 19/286; B65H 75/28; B65H 2406/20; B65H 2701/1924; B65H 2301/41429; B65B 63/02; B65B 63/005; A47K 10/16; A47K 10/22; A47K 10/24; A47K 2010/326; B65D 85/671; B32B 17/10256; B32B 38/14; B32B 3/145

See application file for complete search history.

(56) References Cited

U.S. PATENT DOCUMENTS

| | | | |
|---|---|---|---|
| 325,410 | A | 9/1885 | Hicks |
| 733,282 | A | 7/1903 | Scott |
| 3,899,075 | A | 8/1975 | Hall et al. |
| 4,171,047 | A | 10/1979 | Doyle et al. |

(Continued)

FOREIGN PATENT DOCUMENTS

| | | | |
|---|---|---|---|
| CN | 102578945 | A | 7/2012 |
| JP | 2012250020 | A | 12/2012 |
| JP | 2015047401 | A | 3/2015 |

*Primary Examiner* — Michael R Mansen
*Assistant Examiner* — Raveen J Dias
(74) *Attorney, Agent, or Firm* — Laura L. Bozek

(57) ABSTRACT

Embodiments of a compressed and coreless roll of sheet product having a center indicator are disclosed. According to an embodiment of the present invention, a compressed coreless roll of sheet product is provided. The compressed coreless roll of sheet product includes a sheet product having a first end and a second end. The sheet product is wound about an axis beginning with the first end and ending with the second end to partially define an axial cavity along the axis. The first end includes an indicator that is visible when the sheet product roll is compressed such that the axial cavity is substantially collapsed.

12 Claims, 4 Drawing Sheets

(56) References Cited

U.S. PATENT DOCUMENTS 4,487,378 A 12/1984 Kobayashi
4,601,938 A * 7/1986 Deacon ..... A47L 13/17 428/153
4,760,970 A 8/1988 Larsson et al.
4,901,663 A 2/1990 De Luca
5,186,099 A 2/1993 Qing et al.
5,281,386 A 1/1994 Weinert
5,875,985 A 3/1999 Cohen et al.
6,257,410 B1 7/2001 Ulmann et al.
6,405,969 B1 6/2002 Ogren et al.
7,793,608 B1 9/2010 Udouj
7,951,440 B2 5/2011 Butler, III
7,992,818 B2 8/2011 Maddaleni et al.
8,747,721 B2 6/2014 Haque et al.
9,227,281 B1 1/2016 Meadows
9,227,374 B2 1/2016 Haque et al.
2003/0132330 A1* 7/2003 Kubota ..... A47K 10/16 242/160.1
2003/0145778 A1* 8/2003 Judge ..... A47K 10/16 116/299
2007/0057103 A1 3/2007 Malecot et al.
2009/0057169 A1 3/2009 Kruchoski et al.
2009/0057456 A1 3/2009 Shannon et al.
2010/0009826 A1 1/2010 Basin et al.
2010/0320302 A1 12/2010 Pappas et al.
2011/0079671 A1* 4/2011 Wojcik ..... B65H 19/2276 242/160.1
2011/0095116 A1 4/2011 Hada et al.
2011/0210199 A1 9/2011 Sinsabaugh
2013/0193248 A1 8/2013 Orozco Ramirez et al.
2013/0193249 A1 8/2013 Orozco Ramirez et al.
2013/0299622 A1 11/2013 Trainer, Jr. et al.
2016/0137398 A1 5/2016 Lemke et al.
2017/0280946 A1 10/2017 Weisang et al.
2018/0273329 A1 9/2018 Nagubadi

* cited by examiner

COMPRESSED CORELESS ROLL OF SHEET PRODUCT HAVING A CENTER INDICATOR

PRIORITY CLAIM

This application is a division of U.S. patent application Ser. No. 15/908,622, filed Feb. 28, 2018, which claims the benefit of U.S. Provisional Patent Application No. 62/476,915, filed Mar. 27, 2017, which are hereby incorporated by reference in their entirety.

BACKGROUND

The present disclosure relates generally to sheet products and, more particularly, to a compressed coreless roll of sheet product having a center indicator.

Sheet products, such as tissues, towels, napkins, etc., are often wound about a winding axis to form a roll that defines a cavity along the axis. In some examples, the cavity contains a core around which the sheet product is wound. The core may include a paper, cardboard, plastic, or other rigid or semi-rigid material that substantially maintains the shape of the cavity. In other examples, the cavity does not contain a core. In such cases, the cavity is said to be hollow and/or coreless.

SUMMARY

According to embodiments of the present disclosure, techniques including methods, systems, and/or apparatus for forming a compressed coreless roll of sheet product having a center indicator are provided.

According to an embodiment of the present invention, a compressed coreless roll of sheet product is provided. The compressed coreless roll of sheet product includes a sheet product having a first end and a second end. The sheet product is wound about an axis beginning with the first end and ending at the second end to partially define an axial cavity along the axis. The first end includes an indicator that is visible when the sheet product roll is compressed such that the axial cavity is substantially collapsed.

According to another embodiment of the present invention, a method for forming a compressed coreless roll of sheet product having an indicator is provided. The method includes applying an indicator to an end of a sheet product. The method further includes winding the sheet product about a forming core member starting at the end of the sheet product to which the indicator is applied. The method further includes removing the forming core member to provide a coreless roll of sheet product having an axial cavity.

According to yet another embodiment of the present invention, a compressed coreless roll of sheet product is produced by way of applying an indicator to an end of a sheet product. The compressed coreless roll of sheet product is further produced by way of providing a roll of sheet product by winding the sheet product about a forming core member starting at the end of the sheet product to which the indicator is applied. The compressed coreless roll of sheet product is further produced by way of removing the forming core member to provide a coreless roll of sheet product having an axial cavity. The compressed coreless roll of sheet product is further produced by way of compressing the coreless roll such that the axial cavity is substantially collapsed. The indicator is visible in the substantially collapsed axial cavity.

Additional features and advantages are realized through the techniques of the present disclosure. Other aspects are described in detail herein and are considered a part of the disclosure. For a better understanding of the present disclosure with the advantages and the features, refer to the following description and to the drawings.

BRIEF DESCRIPTION OF THE DRAWINGS

The subject matter which is regarded as the invention is particularly pointed out and distinctly claimed in the claims at the conclusion of the specification. The foregoing and other features, and advantages thereof, are apparent from the following detailed description taken in conjunction with the accompanying drawings in which:

Additional technical features and benefits are realized through the techniques of the present invention. Embodiments and aspects of the invention are described in detail herein and are considered a part of the claimed subject matter. For a better understanding, refer to the detailed description and to the drawings.

DETAILED DESCRIPTION

Embodiments of the present invention provide a compressed coreless roll of sheet product having a center indicator. The term "sheet product" as used herein is inclusive of natural and/or synthetic sheets of paper, cloth, or other materials. Examples of sheet products include, but are not limited to, tissue, towels, non-wovens, napkins, or other fibrous, film, polymer, or filamentary products.

In general, sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products.

Transportation costs add substantially to the cost of sheet products sold for consumer use as the volume of these products is such that when the entire allowable space in a trailer or container is filled with product, the weight is typically far less than the load carrying capacity of the trailer or container. Prime contributors to the excessive volume of these products are the central void which is typically around 40 mm or so and also to a lesser extent the generally cylindrical external shape of the overall product. In practice, when an array of sheet products is packaged in a polyethylene overwrap, the exteriors of the roll are flattened to some extent, increasing the packability of the array of rolls over that which would be predicted based solely on the uncompressed roll diameter. It seems that consumers do not find such rolls objectionable, most likely due to substantial recovery of the cylindrical shape resulting from the resilient nature of absorbent paper products.

However, efforts to eliminate the excess volume contributed by the hollow center void have been less successful in consumer markets, as rolls that have been compressed sufficiently to eliminate the hollow center space can be difficult for consumers to use. For example, it can be difficult for a consumer to locate the axial cavity of the rolls to install the rolls into a suitable dispenser.

Figure 1:
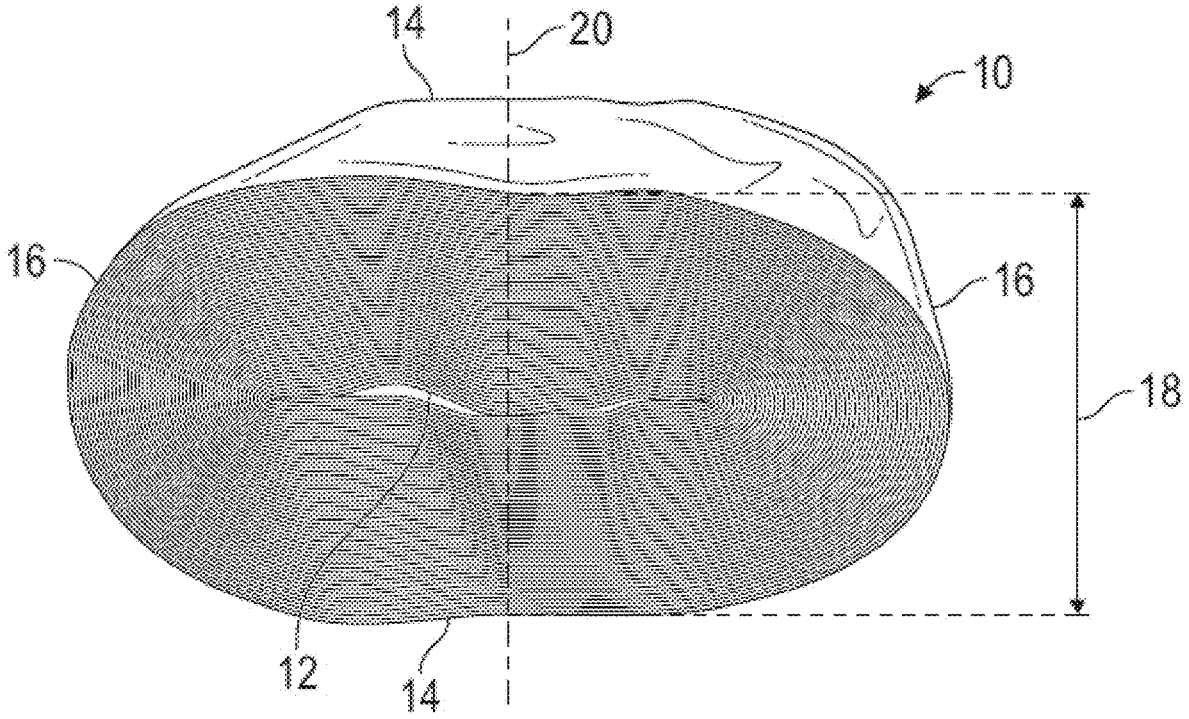
FIG. 1 depicts an end view of a compressed coreless roll of sheet product.

Reference to the axial cavity of the product as "substantially collapsed" is to a flattened form as shown in FIG. 1. Preferably, the gap between opposing sides of the cavity in the substantially collapsed configuration is less than 25 mm, preferably less than 10 mm, more preferably less than 5 mm and still more preferably less than 2 mm on average. In a preferred embodiment, opposing sides of the collapsed cavity are in contact over a major portion of their area, preferably over at least about 60%, more preferably over at least about 70%, even more preferably over at least about 80%, and most preferably at least about 90%, when rolls are in the compressed state in which they are shipped.

"Tissue" rolls or similar terminology refers to cellulosic fiber tissue products, while "bath tissue" rolls must be flushable and are typically manufactured without a substantial amount of permanent wet strength resin; as opposed to paper toweling, or kitchen roll towel, which has a substantial amount of wet strength resin. Moreover, the most preferred bath tissue is predominantly (over 50% dry weight) composed of hardwood fiber such as *eucalyptus* fiber, although many grades, particularly commercial and economy grades, have ever increasing recycled content of uncertain origin. Bath tissue generally has a basis weight of anywhere from 8 to 35 lbs per 3000 square foot ream, with 2 and 3 ply products typically having a basis weight of from 20 to 35 lbs per 3000 square foot ream. As mentioned previously, similar savings and advantages are also realizable with kitchen roll towel as well as any absorbent paper product sold in roll form. Preferably, embodiments of the invention are employed with respect to absorbent papers in which the sheets are not spoiled or defaced by the compression process. Accordingly, embodiments of the invention can be employed with bath tissue, kitchen roll towel, other paper toweling formats, or even napkin stock.

FIG. 1 depicts an end view of a compressed coreless roll 10 of sheet product. The compressed coreless roll 10 of sheet is produced, for example, by way of providing a roll of absorbent paper sheet by winding the sheet about a forming core member, removing the forming core member such that there is provided a hollow coreless roll of absorbent paper sheet with an axial cavity, and compressing the hollow coreless roll such that the axial cavity is substantially collapsed. A compressed "hollow" or "coreless" roll refers to a roll of tissue from which either a conventional cylindrical board stock tube has been removed or a roll of tissue from which the central portion of the roll has been removed leaving a hollow cavity therethrough. Note the absence of any hollow cylindrical board stock core in central cavity 12 of the compressed coreless roll 10 of FIG. 1.

Prior to compression, central plugs are preferably removed from substantially hollow coreless rolls using various procedures. Subsequent to core removal, a non-compressed hollow coreless roll (not shown) may be compressed by action of opposed pistons (not shown) bearing against lateral surfaces of the rolls, resulting in the compressed coreless roll 10. Alternatively, a single piston bearing against a roll restrained by a fixed wall may be used.

In some embodiments of the present invention, the plug removed has a diameter of from about 15 mm to 75 mm such that the axial cavity of the roll has a diameter of from 15 mm to 75 mm prior to compression of the roll, and in some embodiments the forming core member has a diameter of from about 37.5 mm to 42.5 mm such that the axial cavity of the roll has a diameter of from 37.5 mm to 42.5 mm prior to compression of the roll.

The forming core member may be a tubular paperboard core or any other suitable collapsible core member, but the forming core is preferably removed prior to completion of roll compression in order to facilitate both compression and re-forming. In some examples, initial compression of the roll while still retaining the core may facilitate removal of the core, particularly if the roll is formed around a conventional paperboard core rather than being formed directly on a mandrel or on a collapsible mandrel.

According to an embodiment of the present invention, the compressed coreless roll 10 is one of many compressed hollow coreless rolls formed as a log during production. The log is then cut into separate rolls (e.g., the compressed coreless roll 10), which may be approximately 3 inches to 5 inches in width, for example, for facial sheet products. Each log may be, for example, 100 inches to 135 inches in width. Accordingly, each log may produce many of the compressed hollow coreless rolls. For example, if a log is 120 inches in length and compressed coreless rolls are desired to be 4 inches in length, the log can produce approximately 30 compressed coreless rolls. In various embodiments, the dimensions of the log and/or compressed coreless rolls can vary without departing from the teachings of the present invention.

In an example of retail/consumer facial sheet products, each compressed coreless roll is approximately 33 feet in length, which can provide approximately 90 to 100 sheets of sheet product on each log, depending on the length of each sheet. In an example of commercial facial sheet products, each log is approximately 333 feet in length, which can provide approximately 900 to 1000 sheets of sheet product on each log, depending on the length of each sheet. It should be appreciated that the length of each compressed coreless roll can vary according to the embodiments of the present invention.

In FIG. 1, compressed coreless roll 10 maintains a flattened shape having: a substantially collapsed central cavity 12, a pair of longer sides 14 which may be relatively flattened and may have a central portion which approaches being generally planar; a pair of shorter sides 16, which, at least after initial compression, are more rounded and may even approach being generally semi-cylindrical. The compressed coreless roll 10 is characterized largely by a thickness 18 measured from the perpendicular longer sides 14 through the central axis 20 of the substantially collapsed central (axial) cavity 12 which corresponds to the central axis of the forming core member (not shown) about which the absorbent sheet was wound.

When the axial cavity is substantially collapsed, as depicted in FIG. 1, the central (axial) cavity 12 of the compressed coreless roll 10 "disappears" or is otherwise difficult to see or locate. That is, a user of the compressed coreless roll 10 may be unable to locate the central (axial) cavity 12.

Figure 2:
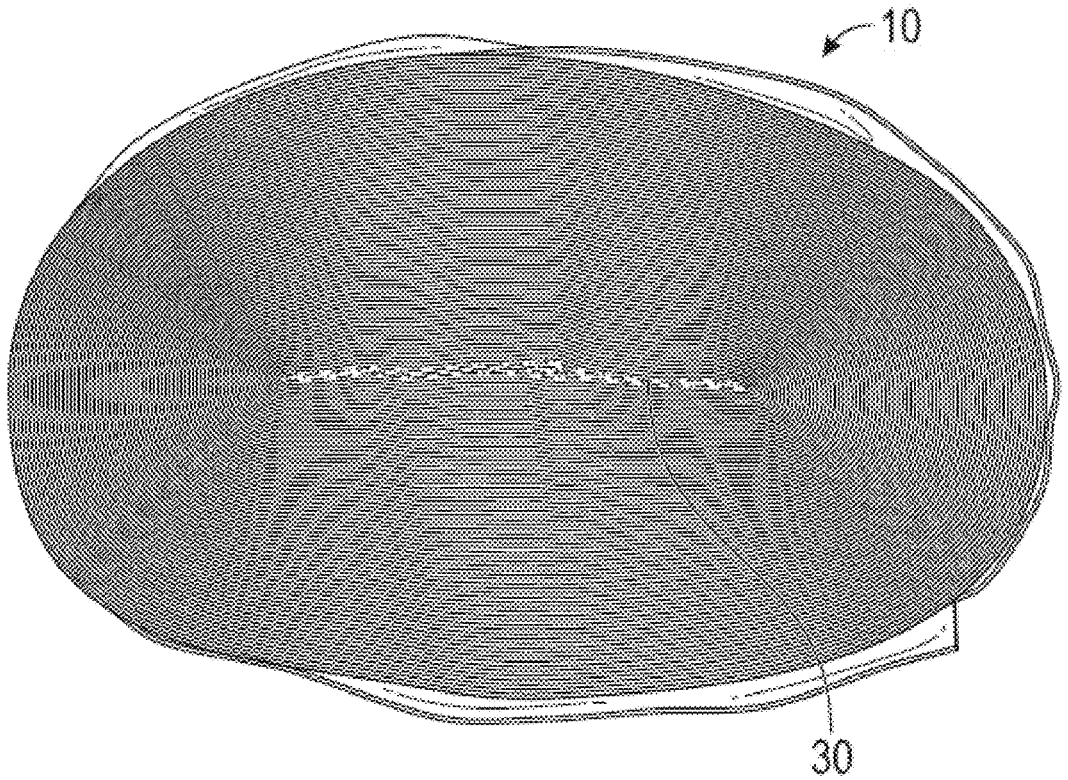
FIG. 2 depicts an end view of a compressed coreless roll of sheet product having an indicator according to embodiments of the present invention.

Embodiments of the present invention solve this problem by applying an indicator to an end of the sheet product that makes up the central (axial) cavity 12 of the compressed coreless roll 10. In particular, FIG. 2 depicts an end view of a compressed coreless roll 10 of sheet product having an indicator 30 according to embodiments of the present invention. As can be appreciated, the indicator 30 provides a user of the compressed coreless roll 10 with a visual reference for locating the central (axial) cavity 12 of the compressed coreless roll 10. This may be particularly useful to locate the central (axial) cavity 12 to insert a core plug into the central (axial) cavity 12, to install the compressed coreless roll 10 into a suitable dispenser, etc.

The indicator is applied to an end of the sheet product that is first wound about a forming core member (not shown) during production. In embodiments of the present invention, the indicator is applied by spraying the first few inches, first few sheets, etc., of the first end of the sheet product with a substance that is a different color than the sheet product. For example, the indicator can be applied as a liquid spray that contains a coloring agent/dye to cause the portion of the sheet paper to which the product is applied to turn a different color.

According to some embodiments of the present invention, the liquid spray is colored water having a coloring agent/dye. During the manufacturing process of the compressed coreless roll 10, the colored water is applied (e.g., sprayed, etc.) directly onto the first end of the sheet product before the sheet product is wound about the forming core member. In some embodiments, the colored water is allowed to dry on the sheet product before the winding; however, in some embodiments, the winding occurs before the colored water is allowed to dry on the sheet product.

According to some embodiments of the present invention, the liquid spray is colored adhesive. During the manufacturing process of the compressed coreless roll 10, the colored adhesive is applied (e.g., sprayed, etc.) directly onto the first end of the sheet product before the sheet product is wound. Using adhesive is beneficial during the winding to enabling the sheet product to adhere to the forming core member.

In yet another embodiment of the present invention, the indicator can be printed on a portion of the sheet product using traditional printing techniques. The indicator may be solid, striped, dotted, or some other pattern that is visually distinguished from the rest of the sheet product.

In at least one embodiment of the present invention, the liquid spray is a colored adhesive (also known as "transfer glue") applied to the forming core member. In such cases, the colored adhesive is printed or extruded on the forming core member. The sheet product is then temporarily bonded to the forming core member for winding. The colored adhesive (i.e., transfer glue) contains a dye or other coloring agent to cause the first end of the sheet paper to be a different color, thus creating the indicator 30.

By changing the color of a portion of the sheet product, the indicator 30 appears in visual contrast to the rest of the sheet product of the compressed coreless roll 10 so that a user can more easily locate the central (axial) cavity 12.

Figure 3:
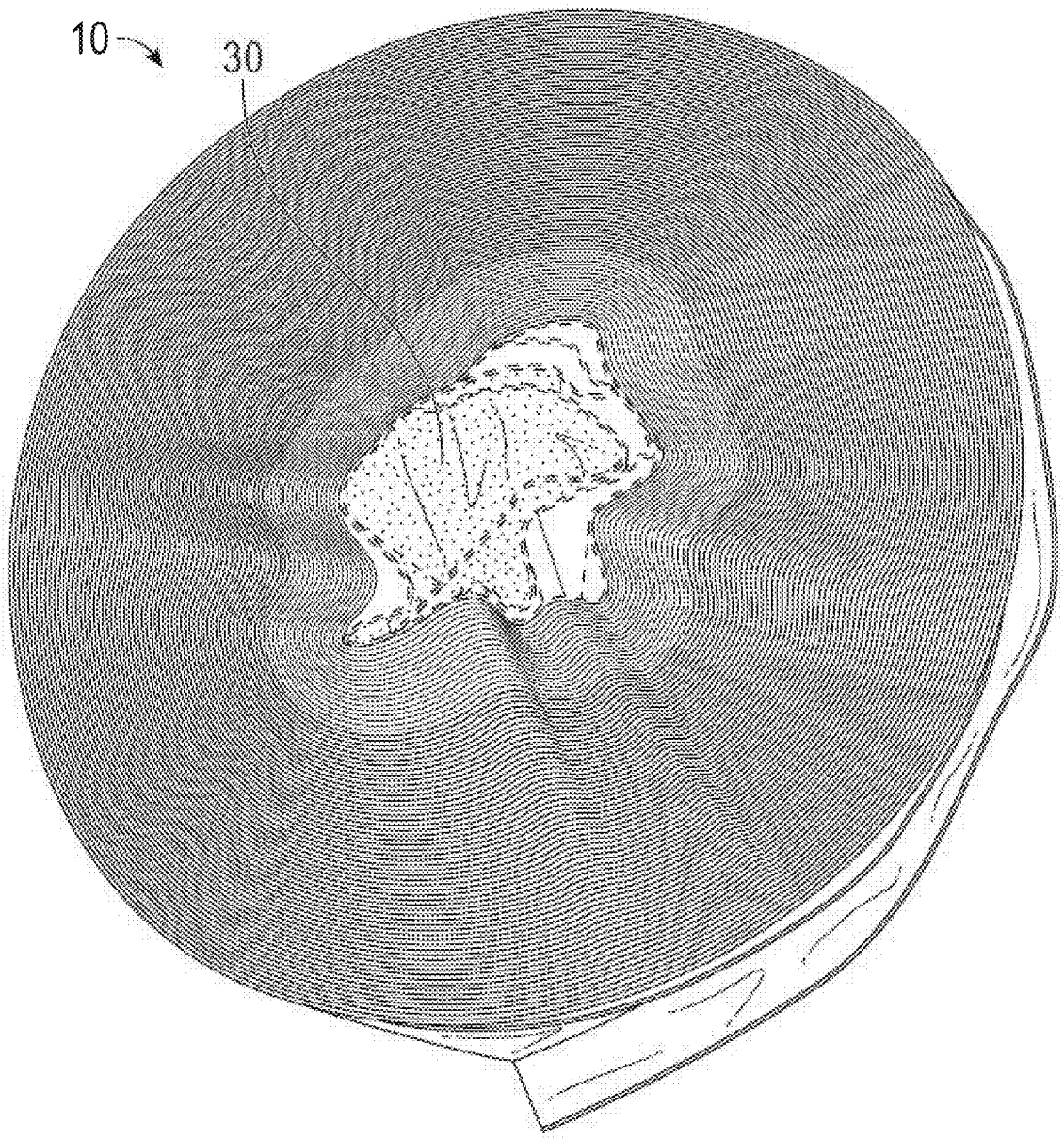
FIG. 3 depicts an end view of a coreless roll of sheet product having an indicator according to embodiments of the present invention.

FIG. 3 depicts an end view of a coreless roll 10 of sheet product having an indicator 30 according to embodiments of the present invention. In the embodiment of FIG. 3, the coreless roll 10 is shown prior to compression and/or after decompression (such as by a user). The indicator 30 is shown as being applied to several layers (i.e., sheets) of the first end of the sheet product.

Figure 4:
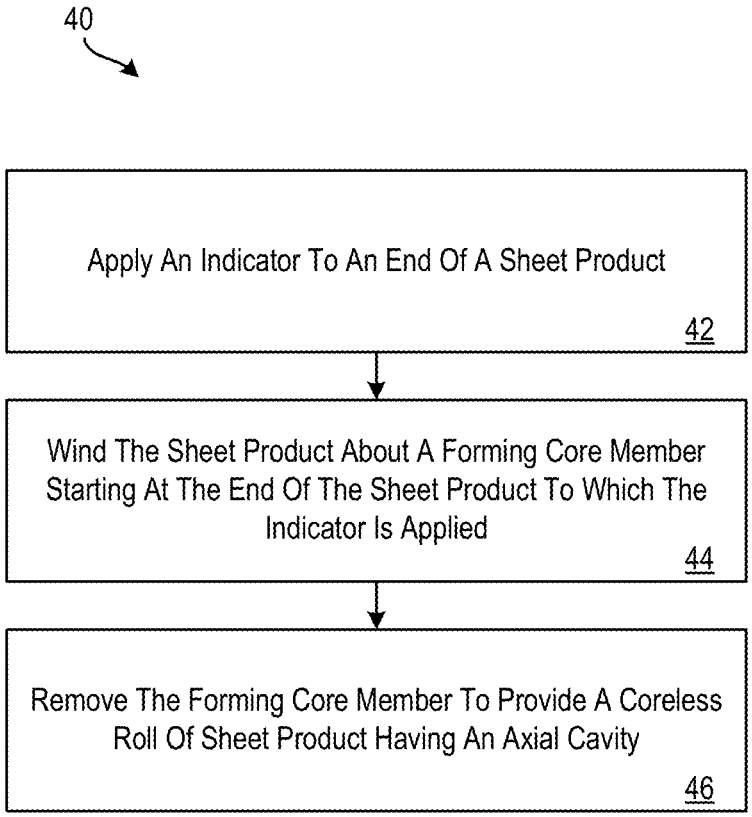
FIG. 4 depicts a method for forming a compressed coreless roll of sheet product having an indicator according to embodiments of the present invention.

FIG. 4 depicts a method 40 for forming a compressed coreless roll of sheet product having an indicator according to embodiments of the present invention. At block 42, an indicator 30 is applied to an end of a sheet product. Applying the indicator can include applying colored water and/or applying colored adhesive, such as by spraying the indicator 30 on an end of the sheet product or by applying the adhesive to a forming core member.

At block 44, the sheet product is wound about a forming core member starting at the end of the sheet product to which the 30 indicator is applied. At block 46, the forming core member is removed to provide a coreless roll of sheet product having an axial cavity 12.

In embodiments of the present invention, the method 40 further includes compressing the coreless roll such that the axial cavity is substantially collapsed. Once compressed, the indicator 30 is visible in the substantially collapsed axial cavity 12.

Additional processes also may be included, and it should be understood that the processes depicted in FIG. 4 represent illustrations and that other processes may be added or existing processes may be removed, modified, or rearranged without departing from the scope and spirit of the present disclosure.

Figure 5:
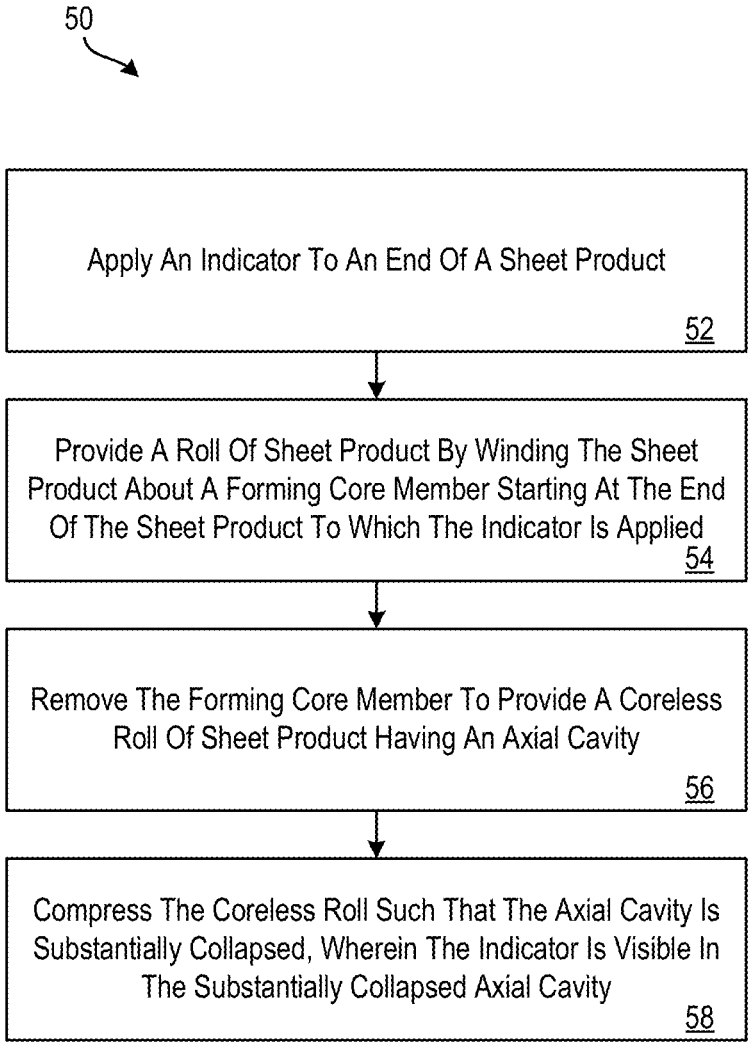
FIG. 5 depicts a method of producing a compressed coreless roll of sheet product having an indicator according to embodiments of the present invention.

FIG. 5 depicts a method 50 of producing a compressed coreless roll of sheet product having an indicator according to embodiments of the present invention. At block 52, an indicator 30 is applied to an end of a sheet product. Applying the indicator can include applying colored water and/or applying colored adhesive, such as by spraying the indicator 30 on an end of the sheet product or by applying the adhesive to a forming core member.

At block 54, a roll of sheet product is provided by winding the sheet product about a forming core member starting at the end of the sheet product to which the indicator is applied. At block 56, the forming core member is removed to provide a coreless roll of sheet product having an axial cavity. At block 58, the coreless roll is compressed such that the axial cavity is substantially collapsed. The indicator is visible in the substantially collapsed axial cavity.

Additional processes also may be included, and it should be understood that the processes depicted in FIG. 5 represent illustrations, and that other processes may be added or existing processes may be removed, modified, or rearranged without departing from the scope and spirit of the present disclosure.

The descriptions of the various examples of the present disclosure have been presented for purposes of illustration but are not intended to be exhaustive or limited to the embodiments disclosed. Many modifications and variations will be apparent to those of ordinary skill in the art without departing from the scope and spirit of the described techniques. The terminology used herein was chosen to best explain the principles of the present techniques, the practical application or technical improvement over technologies found in the marketplace, or to enable others of ordinary skill in the art to understand the techniques disclosed herein.

What is claimed is:

1. A method for forming a compressed coreless roll of sheet product having an indicator, the method comprising:

applying an indicator to an end of a sheet product;

providing a roll of sheet product by winding the sheet product about a forming core member starting at the end of the sheet product to which the indicator is applied;

initially compressing the roll of sheet product while still retaining the forming core member thereby facilitating removal of the forming core member;

removing, subsequent to initially compressing the roll of sheet product, the forming core member to provide a coreless roll of sheet product having an axial cavity; and compressing, subsequent to removing the forming core member, the coreless roll of sheet product such that the axial cavity is substantially collapsed.

2. The method of claim 1, wherein applying the indicator comprises applying colored water to the end of the sheet product.

3. The method of claim 1, wherein applying the indicator comprises applying colored adhesive to the forming core member and transferring the colored adhesive to the end of the sheet product.

4. The method of claim 1, wherein applying the indicator comprises spraying the indicator on the end of the sheet product.

5. The method of claim 1, wherein applying the indicator comprises printing the indicator on the end of the sheet product.

6. The method of claim 1, wherein the indicator is visible in the substantially collapsed axial cavity.

7. A compressed coreless roll of sheet product produced by way of:

applying an indicator to an end of a sheet product;

providing a roll of sheet product by winding the sheet product about a forming core member starting at the end of the sheet product to which the indicator is applied;

initially compressing the roll of sheet product while still retaining the forming core member thereby facilitating removal of the forming core member;

removing, subsequent to initially compressing the roll of sheet product, the forming core member to provide a coreless roll of sheet product having an axial cavity; and compressing, subsequent to removing the forming core member, the coreless roll of sheet product such that the axial cavity is substantially collapsed, wherein the indicator is visible in the substantially collapsed axial cavity.

8. The compressed coreless roll of sheet product of claim 7, wherein the indicator is colored water applied to the end of the sheet product.

9. The compressed coreless roll of sheet product of claim 7, wherein the indicator is colored adhesive applied to the forming core member and transferred to the end of the sheet product.

10. The compressed coreless roll of sheet product of claim 7, wherein applying the indicator comprises spraying the indicator on the end of the sheet product.

11. The compressed coreless roll of sheet product of claim 7, wherein applying the indicator comprises printing the indicator on the end of the sheet product.

12. The compressed coreless roll of sheet product of claim 7, wherein applying the indicator occurs prior to winding the sheet product about the forming core member.

* * * * *